US006645049B2

(12) United States Patent
Nguyen

(10) Patent No.: US 6,645,049 B2
(45) Date of Patent: Nov. 11, 2003

(54) POLISHING HOLDER FOR SILICON WAFERS AND METHOD OF USE THEREOF

(76) Inventor: Phuong Van Nguyen, 2903 Erica Ct., San Jose, CA (US) 95121

( * ) Notice: Subject to any disclaimer, the term of this patent is extended or adjusted under 35 U.S.C. 154(b) by 15 days.

(21) Appl. No.: 09/962,897

(22) Filed: Sep. 25, 2001

(65) Prior Publication Data

US 2002/0155791 A1 Oct. 24, 2002

Related U.S. Application Data

(63) Continuation-in-part of application No. 09/840,506, filed on Apr. 23, 2001, and a continuation-in-part of application No. 09/908,013, filed on Jul. 18, 2001.

(51) Int. Cl.[7] ..... B24B 1/00

(52) U.S. Cl. ..... 451/29; 451/28; 451/41; 451/60; 451/285; 451/286; 451/287; 451/292; 451/398; 451/401; 451/402; 451/447

(58) Field of Search ..... 451/28, 29, 41, 451/60, 285, 286, 287, 289, 292, 398, 401, 402, 447

(56) References Cited

U.S. PATENT DOCUMENTS 4,165,584 A * 8/1979 Scherrer ..... 451/289
4,512,113 A * 4/1985 Budinger ..... 451/397

* cited by examiner

*Primary Examiner*—Joseph J. Hail, III
*Assistant Examiner*—Shantese McDonald
(74) *Attorney, Agent, or Firm*—Michael I. Kroll

(57) ABSTRACT

An method and apparatus for forming wafers of varying thickness'. The apparatus includes a template. The template is formed of a main disk including a plurality of cavities extending into a first side thereof. Each cavity has notches cut in the walls thereof and a pattern etched in the base thereof. Holding disks are moistened and positioned within respective cavities for releasably securing a wafer in the cavity. A moistening liquid is dispensed and diffuses into the cavities via the notches cut in the walls and collects in the pattern etched on the base of the cavity thereby increasing the suctional force used to secure the holding disk. When the template is releasably secured within a cavity, rotatably connected to a rotating head and positioned such that the first side faces a lapping and polishing surface, wafers received by the cavities are lapped and polished upon rotation of the rotating head.

20 Claims, 6 Drawing Sheets

POLISHING HOLDER FOR SILICON WAFERS AND METHOD OF USE THEREOF

This application is a continuation-in-part application of U.S. patent applications:

a. Ser. No. 09/840,506 filed Apr. 23, 2001 (attorney docket no. PN-1); and b. Ser. No. 09/908,013 filed Jul. 18, 2001 (attorney docket no. PN-2).

BACKGROUND OF THE INVENTION

1. Field of the Invention

The present invention relates generally to devices for polishing workpieces and, more specifically, to a device for polishing silicon wafers including a planar template having a plurality of cavities with notches cut in the walls therein and patterns etched on the base thereof for increasing suction between the template and a silicon wafer placed within a respective cavity when polishing the wafer to a thickness equivalent to the depth of the template cavity.

2. Description of the Prior Art

The prior art discloses numerous templates for lapping and polishing wafers to a desirable thickness determined by the depth of the template cavity. However, the prior art devices and methods each contain one or more undesirable characteristics that render them unsuitable for repeated use.

A prior art process of lapping and polishing blank wafers includes placing the workpieces into a template and placing the template upside down between a rotating pneumatic head and a table. A controlled flow of abrasive slurry flows onto the table surface during rotation of the pneumatic head whereby the wafer blanks are honed and polished to the thickness of the template.

There are two undesirable side effects that can occur with this method. As the wafers approach the thickness of the template cavity, the amount of fluid between the template and table decreases causing spotted changes in the surface temperature of the template and thereby burnishing the template. In addition, the cross sectional thickness of the finished wafer is affected. The wafers rotate within the cavity causing the wafers to continuously butt up against the wall of the cavity and rise from the cavity base. This potentially causes the edge thickness of the wafer to vary from the center thickness, especially in applications where tolerances are measured in the +/− tens of picometers.

It is thus desirable to provide a method and apparatus for polishing a wafer which overcomes both of the above discussed shortcomings with the prior art. It is further desirable to provide a method and apparatus for polishing a wafer which is able to increase the efficiency of present methods by reducing the number of templates used. It is even further desirable to provide a method and apparatus for polishing a wafer which is able to account for the varied thickness' within the end product.

Therefore because of the aforementioned problem it is felt that a need exists for the present invention and while the prior art may be suitable for the purposes for which they were designed, they would not be a suitable for the purposes of the present invention, as hereinafter described.

SUMMARY OF THE PRESENT INVENTION

The present invention relates generally to devices for polishing workpieces and, more specifically, to a device for polishing silicon wafers including a planar template having a plurality of cavities with notches cut in the walls therein and patterns etched on the base thereof for increasing suction between the template and a silicon wafer placed within a respective cavity when polishing the wafer to a thickness equivalent to the depth of the template cavity.

A primary object of the present invention is to provide a method and apparatus for lapping and polishing silicon wafers that will overcome the shortcomings of prior art devices.

Another object of the present invention is to provide a method and apparatus for lapping and polishing silicon wafers that can be used repeatedly.

Yet another object of the present invention is to provide a method and apparatus for lapping and polishing silicon wafers wherein the apparatus includes templates substantially comprised of fiberglass-epoxy laminates.

Another object of the present invention is to provide a method and apparatus for lapping and polishing silicon wafers wherein the templates include a backing adhesively affixed thereto formed from mylar or other suitable frictionless material.

Yet another object of the present invention is to provide a method and apparatus for lapping and polishing silicon wafers wherein a shim is affixed to the base of the plurality of cavities within said template thereby adjusting the depth of the cavity.

Another object of the present invention is to provide a method and apparatus for lapping and polishing silicon wafers wherein the cavities include grooves and notches cut therein thereby aiding the suctional force created between the shims and the base of the cavity.

Still yet another object of the present invention is to provide a method and apparatus for lapping and polishing silicon wafers wherein the affixed shim is of smaller diameter than the diameter of the plurality of workpiece cavities within the template and the periphery of the wafer contained within the workpiece cavity extends beyond the circumference of the shim.

Yet another object of the present invention is to provide a method and apparatus for lapping and polishing silicon wafers able to reduce tapering of the wafer.

Another object of the present invention is to provide a method and apparatus for lapping and polishing silicon wafers wherein the plurality of shims are of various thickness' that can be removably inserted into each of the plurality of cavities within the template.

Yet another object of the present invention is to provide a method and apparatus for lapping and polishing silicon wafers wherein the template can be used to produce wafers of various and/or calculated thickness'.

Additional objects of the present invention will appear as the description proceeds.

A method and apparatus for forming wafers of varying thickness' is disclosed by the present invention. The apparatus includes a template. The template is formed of a main disk including a plurality of cavities extending into a first side thereof. The plurality of cavities include notches cut into the walls thereof and further having patterns etched on the base thereof. Holding disks are moistened and positioned within respective cavities for releasably securing a wafer in the cavity. When the template is releasably secured to and rotatable with a rotating head and positioned such that the first side faces a lapping and polishing surface, wafers received by the cavities are lapped and polished upon rotation of the rotating head. A plurality of shims are selectively received within respective cavities between a base of the cavity and the holding disk for adjusting a depth of the cavity thereby adjusting an amount of a wafer to be lapped and polished. The shims have varying thickness' and are color coated, each color being representative of a predetermined thickness for the shim. A mylar layer is bonded to a side opposite the side of the main disk where the plurality of cavities extend therethrough. A liquid is provided atop the lapping and polishing surface upon rotation of the templates. The liquid diffuses into the plurality of cavities via the notches cut in the walls of the cavities. Upon settling in the pattern etched onto the base of the cavities, an increased suctional force is created between the base of the cavity and the shim.

The present invention overcomes the shortcomings of the prior art by providing a method and device whereby employing the reusable workpiece template and selectively inserting shims of various thickness' produce semiconductor wafers of varying thickness'.

In addition, the workpiece template having a shim centrally affixed and positioned within the base of the workpiece cavities reduce tapering of the wafer. Furthermore, having a suitable frictionless material, such as mylar, induce rotation of the wafer thereby reducing tapering.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
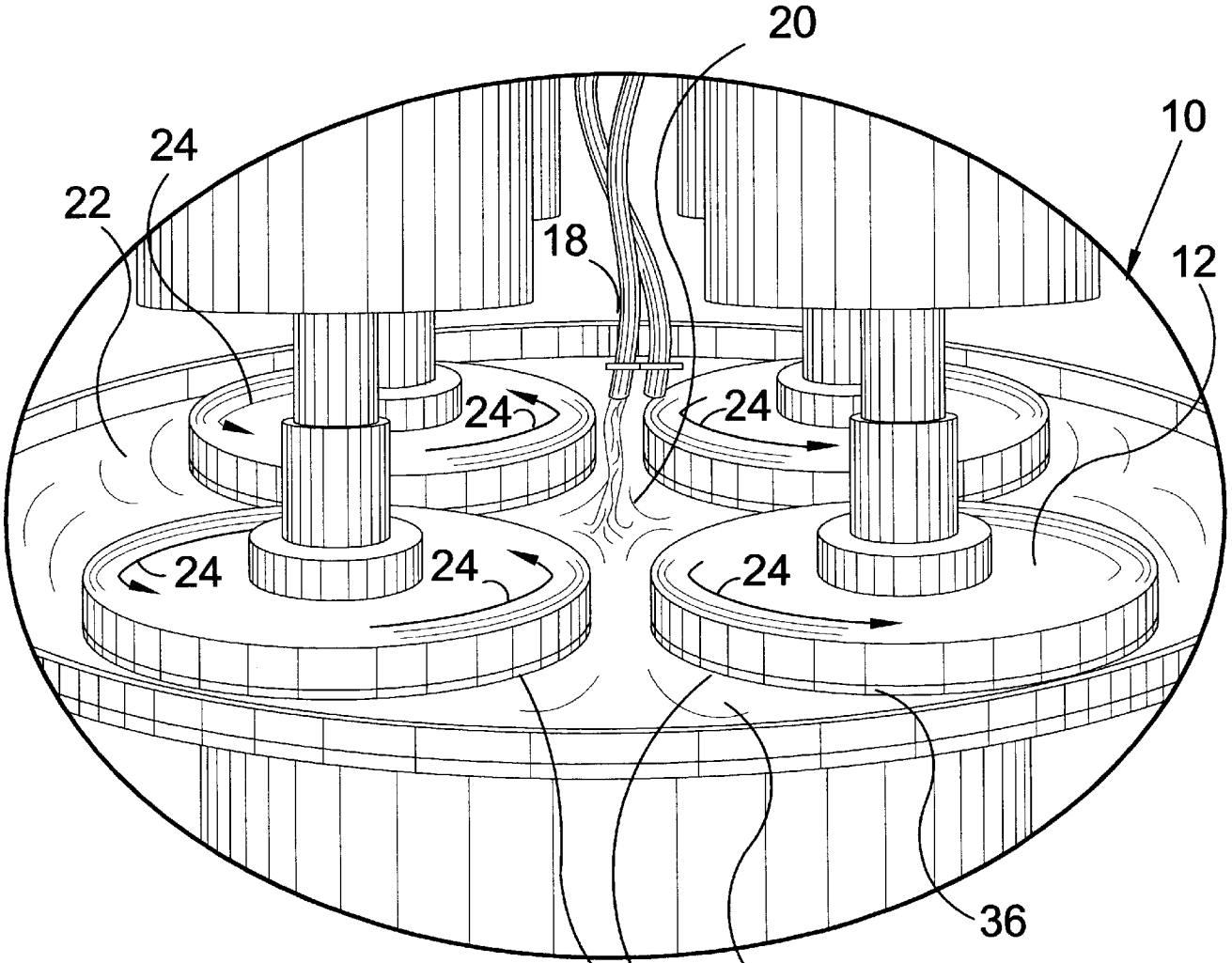
FIG. 1 is a perspective view of the silicon wafer polishing holder of the present invention.

Turning now descriptively to the drawings, in which similar reference characters denote similar elements throughout the several views, the Figures illustrate the silicon wafer polishing holder of the present invention, With regard to the reference numerals used, the following numbering is used throughout the various drawing figures.

10 silicon wafer polishing holder of the present invention
12 rotating pneumatic heads
14 lapping and polishing surface
16 workpiece template
18 tube
20 supply of moistening liquid
22 top side of lapping and polishing surface
24 arrows indicating rotation of the rotating pneumatic head
26 cavity within workpiece template
28 bottom surface of workpiece template
30 shim
32 top side of the workpiece template
33 wall of the cavity
34 notch in cavity
36 main plate
38 base of cavity
40 mylar layer
41 adhesive layer
42 holding disk
44 wafer
45 pattern cut into the base of the cavity
46 a first pattern cut in the base of the cavity
47 a first cavity
48 a second pattern cut in the base of the cavity
49 a second cavity
50 a third pattern cut in the base of the cavity
51 a third cavity
52 a fourth pattern cut in the base of the cavity
53 a fourth cavity
54 a fifth pattern cut in the base of the cavity
55 a fifth cavity
56 a sixth pattern cut in the base of the cavity
57 a sixth cavity
58 a seventh pattern cut in the base of the cavity
59 a seventh cavity
60 a circle
62 an arc
64 a line
66 a bean shaped opening

DETAILED DESCRIPTION OF THE PREFERRED EMBODIMENT

Turning now descriptively to the drawings, in which similar reference characters denote similar elements throughout the several views, FIGS. 1 through 6 illustrate the silicon wafer polishing holder of the present invention indicated generally by the numeral 10.

The silicon wafer polishing holder 10 of the present invention is shown polishing a wafer in FIG. 1. As can be seen from this view, the silicon wafer polishing holder 10 includes a plurality of rotating pneumatic heads 12. The plurality of rotating pneumatic heads 12 are positioned above a lapping and polishing surface 14. A workpiece template 16 is positioned between the lapping and polishing surface 14 and a respective one of each of the plurality of rotating pneumatic heads 12. The rotating heads rotate as indicated by the arrows labeled with the numeral 24. Each workpiece template 16 includes a main plate 36 having a plurality of cavities extending therein. The cavities extend at least partially through the main plate and possible entirely through the main plate 36. Each cavity is able to receive a silicon wafer, not shown in this figure. Each workpiece template 16 is positioned under and rotated by the respective rotating pneumatic head 12. The workpiece templates 16 place the silicon wafers in communication with the lapping and polishing surface 14 and rotate the silicon wafers generating a frictional force between the silicon wafers and the lapping and polishing surface 14. The frictional force acts to polish the silicon wafers. A tube 18 is positioned above the lapping and polishing surface 14 for providing a supply of moistening liquid 20 to a top side 22 of the lapping and polishing surface and between the lapping and polishing surface 14 and the workpiece template 16. The supply of the moistening liquid 20 reduces the heat produced by the friction between the wafer and the lapping and polishing surface 14 while also aiding in producing a suction force to maintain the position of the wafer within the cavity.

Figure 2:
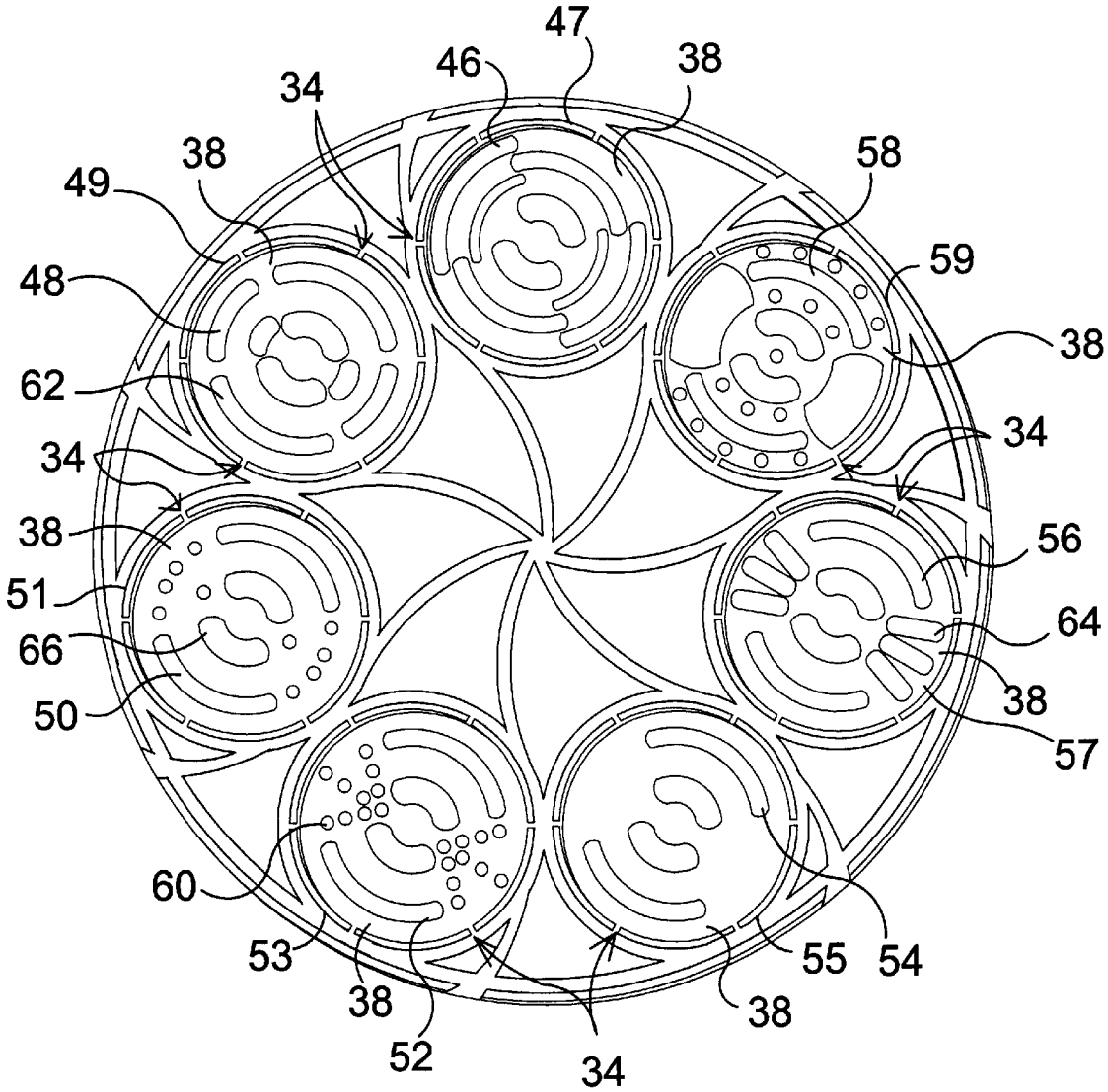
FIG. 2 is a top side view of a workpiece template used with the silicon wafer polishing holder of the present invention.

A top side view of the main plate 36 of the silicon wafer polishing holder 10 of the present invention is shown in FIG. 2. From this view, the main plate 36 is shown having a first cavity 47, a second cavity 49, a third cavity 51, a fourth cavity 53, a fifth cavity 55, a sixth cavity 57, and a seventh cavity 59. The above cavities are noted generally with the reference numeral 26. Seven cavities are illustrated for purposes of example. However, it is to be realized that any desired number of cavities may be cut into the main plate 36. The plurality of cavities 26 extend at least partially through the main plate 36. Each cavity 26 has notches 34 cut in wall thereof. The notches 34 allow for moistening liquid to penetrate the cavity 26. Further, each cavity 26 has a base 38. A pattern 45 is etched in the base 38 of each respective cavity 26. The pattern 45 etched in the base 38 of a respective cavity 26 is carved to a predetermined depth. The depth of each pattern should be sufficient to allow for moistening liquid to collect thereby increasing the suction between a holding disk 42 and the base of the cavity 38. FIG. 2 shows different patterns 45 that can be etched into the base 38 of each respective cavity 26. A first pattern 46 is etched into the base 38 of the first cavity 47. A second pattern 48 is etched into the base 38 of the second cavity 49. A third pattern 50 is etched into the base 38 of the third cavity 51. A fourth pattern 52 is etched into the base 38 of a fifth cavity 53. A fifth pattern 54 is etched into the base 38 of the fifth cavity 55. A sixth pattern 56 is etched into the base 38 of the sixth cavity 57. A seventh pattern 58 is etched into the base 38 of the seventh cavity 59. The patterns 45 illustrated are formed from a combination of circles 60, arcs 62, lines 64, and bean-shaped openings 66. While seven patterns are illustrated herein, they are not limiting in any way and other patterns that successfully achieve increased suction may also be chosen to be etched into the base 38 of a respective cavity 26.

Figure 3:
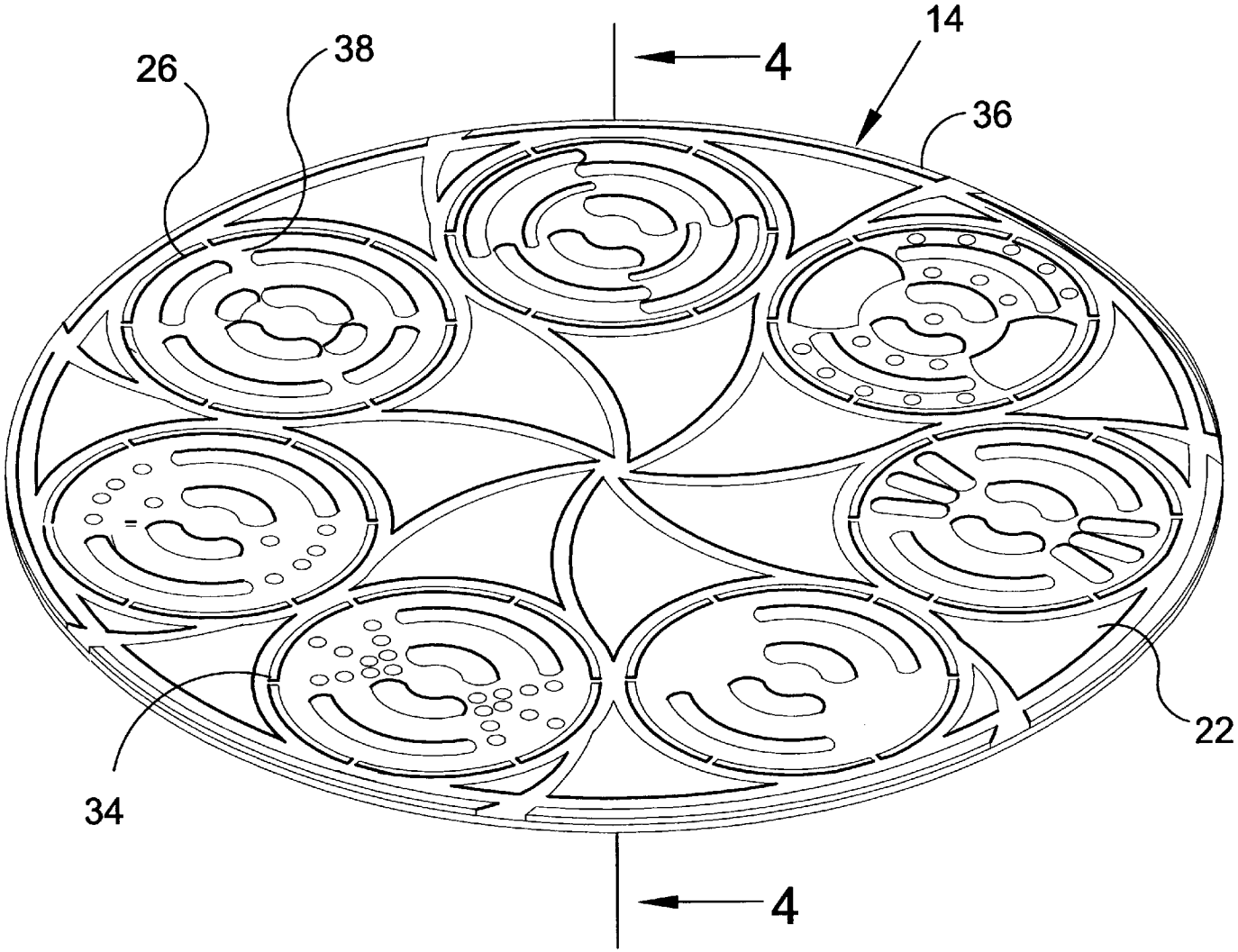
FIG. 3 is a perspective view of the workpiece template of the silicon wafer polishing holder of the present invention.

A perspective top side view of the main plate 36 is illustrated in FIG. 3. This figure shows the top side 22 of the planar main plate 36 including the plurality of cavities 26 extending therein. The main plate 36 is preferably formed of fiberglass-epoxy laminates. Further shown is the plurality of cavities 26 each having a different pattern 45 etched into the base 38 thereof. Each respective cavity 34 has notches cut into a side wall thereof. The notches 34 allow for the moistening liquid to penetrate the cavity 26 and settle into the grooves of the patterns 45 that are etched into the base 38 of the cavity.

Figure 4:
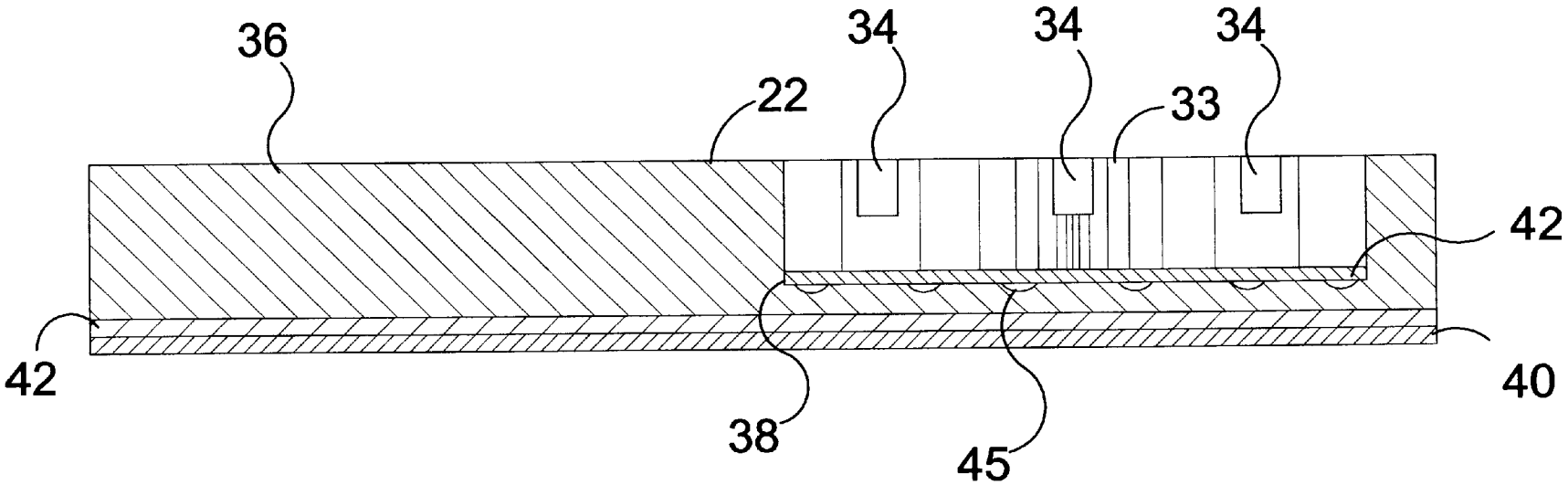
FIG. 4 is a cross sectional view of the workpiece template of the silicon wafer polishing holder of the present invention.

A cross sectional view of the main plate 36 taken along the line 4—4 is shown in FIG. 4. This figure shows the main plate 36 formed from heat and moisture resistant material such as fiberglass-epoxy laminates. Extending into the top side 22 of the main plate 36 and possibly extending through the main plate 36 are the plurality of cavities 26. Each respective cavity 26 has a wall 33 and a base 38. The wall 33 of each respective cavity has a notch 34 cut therein. The base 38 of each respective cavity 26 has a pattern 45 etched thereon. Further shown is the holding plate 42 placed atop the base 38 of the respective cavity 26. On a side of the main plate 36 opposite the top side 22 is the mylar layer 40. The mylar layer 40 is adhesively bonded to the backing plate by an adhesive layer 41.

Figure 5:
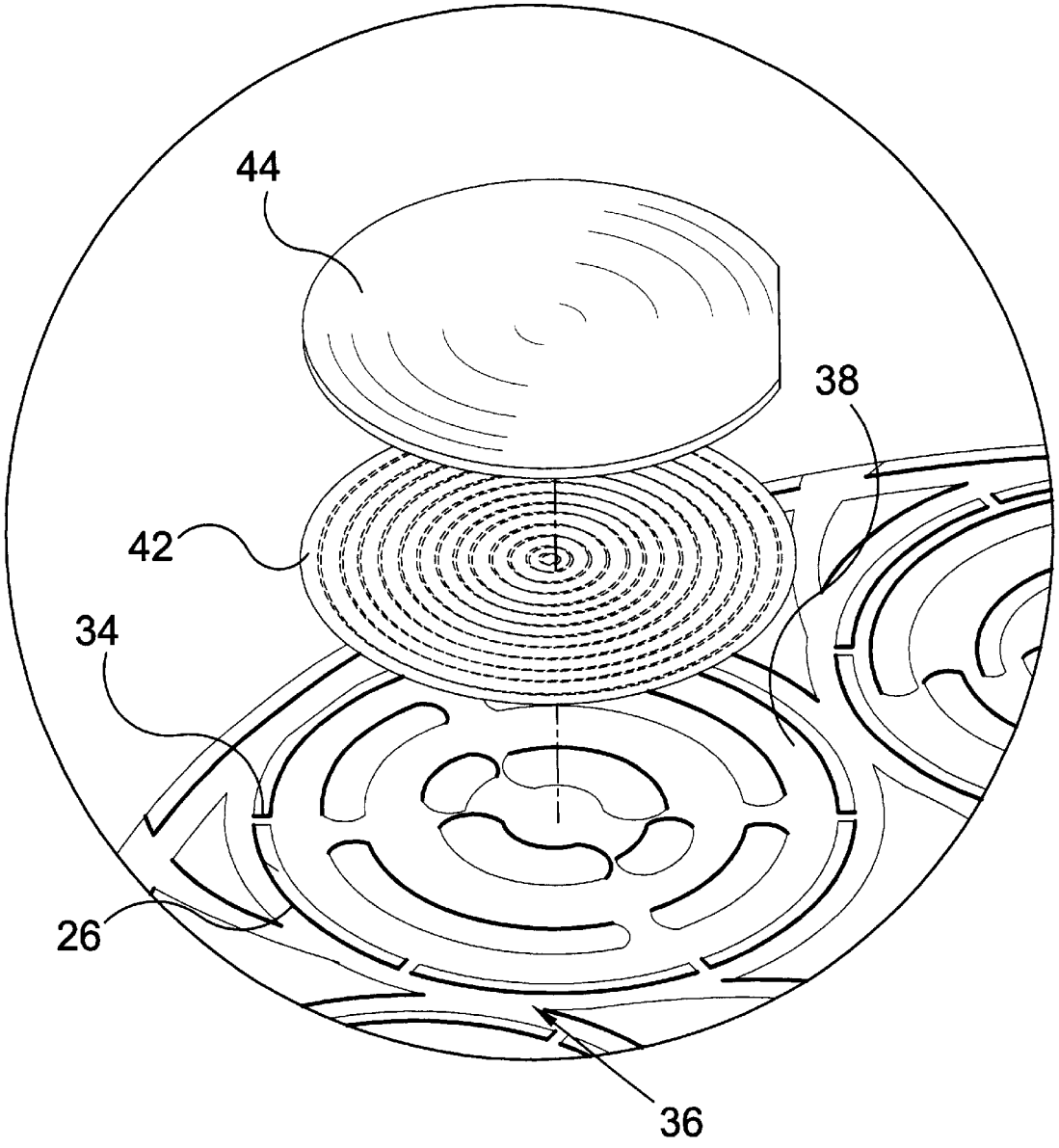
FIG. 5 is an exploded perspective view of the workpiece cavity of the silicon wafer polishing holder of the present invention.

FIG. 5 illustrates an exploded perspective view of the elements within a workpiece cavity 26. FIG. 5 illustrates a cavity 26 without a shim disk 30 therein. As can be seen from these figures, the main disk 36 is positioned atop the mylar layer with the adhesive layer 41 positioned therebetween. Positioned within the cavity 26 and atop the base 38 is the holding disk 42. If shim disks 30 (not shown) are used to adjust the depth of the cavity 26, the shim disks 30 are positioned between the base 38 and the holding disk 42. The holding disk 42 is moistened and the wafer 44 is placed atop the holding disk 42. Moistening of the holding disk 42 creates a suctional force within the cavity 26. The notches 34 in the cavity 26 aid in maintaining the moistness of the holding disk 42. Placement of the wafer 44 atop the moistened holding disk 42 utilizes the suction created to maintain the wafer 42 in a stationary position within the cavity 26. The placement of a shim disk 30 within the cavity decreases the depth of the cavity 26 thereby raising the height of the wafer 44 within the workpiece cavity 26. This creates a cavity having a smaller depth and thus, upon lapping and polishing produces a thinner wafer 44. Using variable amounts of shim disks 30 of differing thickness' allows the creation of a cavity having a desired depth.

Figure 6:
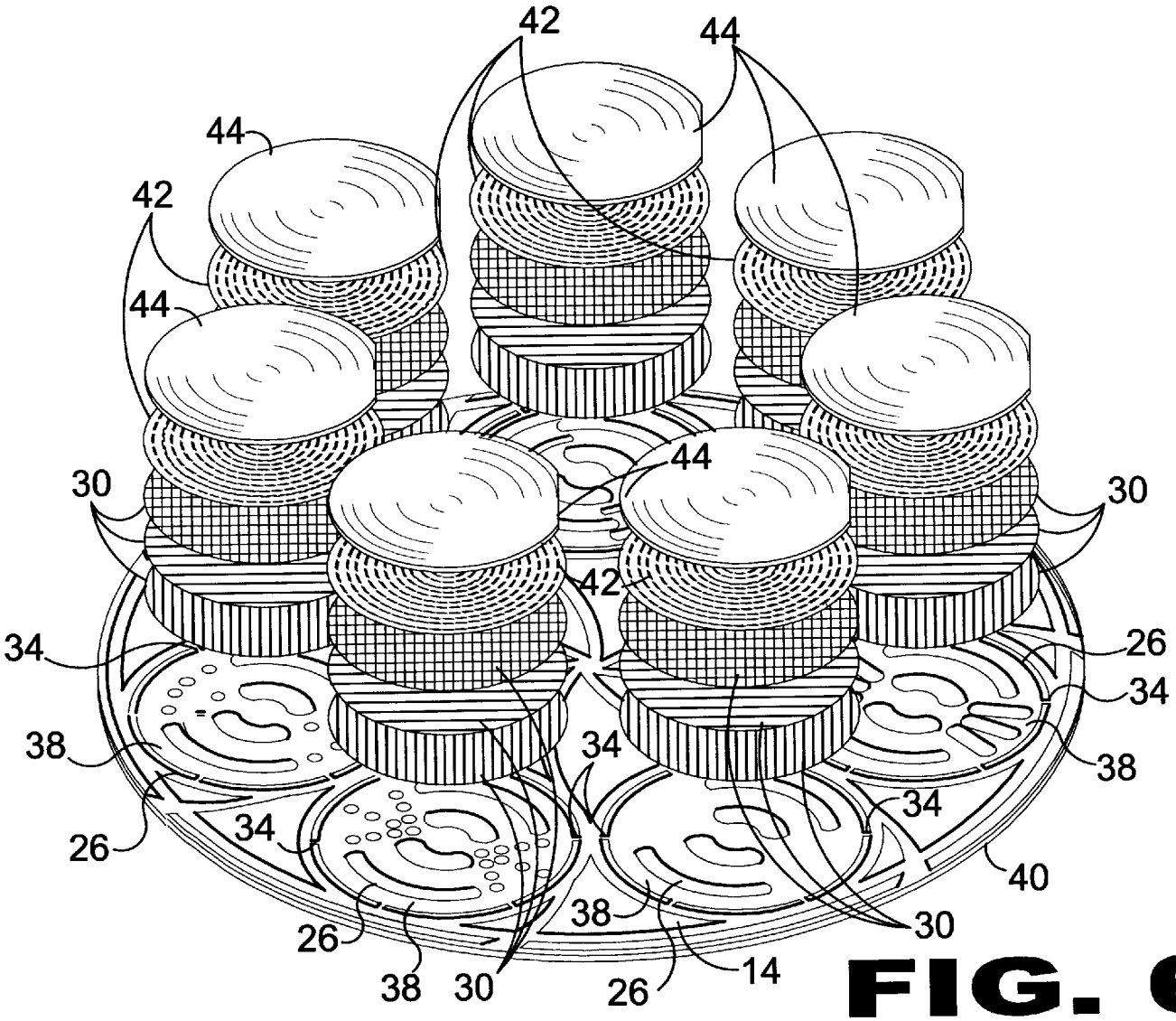
FIG. 6 is a perspective view of the workpiece template the silicon wafer polishing holder of the present invention showing workpiece cavities in exploded form.

FIG. 6 illustrates an exploded view of the cavities 26 of an entire template 14. Each of the cavities 26 has a plurality of shim disks 30 positioned therein to adjust the thickness of the cavity 26. It is thus shown that by positioning differing amounts of shim disks 30 having varying thickness' within each cavity 26, a number of wafers 44 are able to be produced at a single time using a single template 14 whereby each wafer 44 produced can be polished to a desired thickness. This allows for numerous wafers 50 of varying thickness' to be produced at a single time.

The operation of the workpiece template and apparatus for lapping and polishing silicon wafers 10 will now be described with reference to the figures. In operation, the workpiece template and apparatus for lapping and polishing silicon wafers 10 is prepared for use. In preparing the workpiece template and apparatus for lapping and polishing silicon wafers 10, a mylar layer 40 is bonded to a side opposite the top side 22 of the main plate 36 preferably be means of an adhesive layer 41. The main plate 36 contains a plurality of cavities 26 extending at least partially therethrough. Each cavity 26 has a wall 33 and a base 38. The wall 33 of each cavity 26 has notches cut therein and the base 38 of each cavity 26 has a pattern 45 etched therein. Each cavity 26 is now prepared by placing a desired number of shims 30 of varying thickness therein. The number and thickness of the shims 30 placed within each cavity 26 determines the depth of the cavity 26 and the height to which the wafer 44, when placed within the cavity 26 will extend thereabove. After placing the shims 30 in each cavity 26 a holding disk 42 is moistened and positioned within each cavity 26 above the shims 30. The template 14 is now prepared to receive wafers 44 within respective cavities 26. The wafers 44 are positioned within a predetermined cavity 26 having a predetermined depth determined by the number and thickness of shims 30 positioned therein. A portion of the wafer 42 is seated within the cavity and a portion of the wafer 42 is positioned extending through the rim of the cavity 26 and above the top side 22.

The wafers are now prepared to be lapped and polished. The template is now received by the rotating pneumatic head 12 of the apparatus for lapping and polishing silicon wafers 10. When connected to the rotating pneumatic head 12, the template 14 is positioned such that the top 22 and the wafers 44 are directly above the lapping and polishing surface 16. The portion of the wafer 42 is positioned extending through the rim of the cavity 26 and above the top side 22 is placed in contact with the lapping and polishing surface 16. Upon turning on the portion of the wafer 42 is positioned extending through the rim of the cavity 26 and above the top side 28, the rotating pneumatic heads 12 begin to rotate thereby rotating the template 16 and the wafers 44 positioned within the cavities 26. Rotation of the wafers 44 causes a frictional force to develop between the portion of the wafer 44 extending through the rim of the cavity 26 and above the top side 32 and the lapping and polishing surface 22. The frictional force causes lapping and polishing of the wafer 44 to occur. The lapping and polishing of the wafer 44 continues until the portion of the wafer 44 is positioned extending through the rim of the cavity 26 and above the top side 22 is removed and the thickness of the wafer 44 equals the thickness of the portion of the wafer 44 is positioned within the cavity 26. Throughout the rotation of the rotating pneumatic heads 12, a moistening liquid 20 is deposited on top of the lapping and polishing surface thereby cooling the surface. The notches 34 cut in the walls 33 of the cavity 26 allows for the moistening liquid to diffuse to the base 38 of the respective cavity 26. The moistening liquid 20 thereby collects in the pattern 45 etched into the base of the cavity 26. This collection of liquid causes an increased suctional force created between the base 38 of the cavity 26 and either the shim 30 or the holding disk 48, whichever is positioned atop the base 38 of the cavity 26. As each wafer 44 within respective cavities 26 are polished to the same level, i.e. the level of the surface of the main disk 36, the production of all wafers is complete simultaneously. Furthermore, the thickness of each wafer 44 is dependent on the portion of the wafer which extends into the cavity 26. Thus, wafers 44 of various sizes are able to be produced simultaneously.

From the above description it can be seen that the method and apparatus for lapping and polishing silicon wafers of the present invention is able to overcome the shortcomings of prior art devices by providing a method and apparatus for lapping and polishing silicon wafers which is able to be used repeatedly to produce a plurality of silicon wafers. The apparatus for lapping and polishing silicon wafers includes templates having a main disk substantially comprised of fiberglass-epoxy laminates and including cavities extending therein. A backing material adhesively affixed to the main disk and a layer formed of mylar or other suitable frictionless material is affixed to the backing material. A plurality of shims manufactured from a suitable material such as polyurethane may be affixed to the base of the cavities for adjusting the depth of the cavity. The shims are removably inserted into each of the plurality of cavities within the template. The plurality of shims are of various thickness' that can be removably inserted into each of the plurality of cavities within the template whereby the template can be used to produce wafers of various and/or calculated thickness'. The method and apparatus for lapping and polishing silicon wafers is also able to reduce tapering of the wafer. Furthermore, the method and apparatus for lapping and polishing silicon wafers of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A template for forming wafers of varying thickness', said template comprising:

a) a main plate including at least one cavity extending into a first side thereof, said at least one cavity having a base, a wall extending from said base, at least one notch cut in said wall and a pattern etched in said base;

b) at least one holding disk, said at least one holding disk positioned within said at least one cavity and covering said pattern in said base, whereby when said template is releasably secured to and rotatable with a rotating head and positioned such that said first side faces a lapping and polishing surface, a wafer received within said at least one cavity is lapped and polished upon rotation of the rotating head.

2. The template as recited in claim 1, wherein said at least one cavity further includes a plurality of notches cut in the walls therein.

3. The template as recited in claim 1, wherein a liquid is provided atop the lapping and polishing surface upon rotation of said template, said liquid being received within said pattern thereby increasing a suctional force on said at least one holding disk and wafer within said at least one cavity.

4. The template as recited in claim 1, further comprising a shim, said shim being selectively received within said at least one cavity between said at least one holding disk and said base of said at least one cavity for adjusting a depth of said at least one cavity and thereby adjusting an amount of a wafer to be lapped and polished.

5. The template as recited in claim 1, wherein said main plate further comprises a plurality of cavities, each of said plurality of cavities having a base, said base having a pattern etched thereon.

6. The template as recited in claim 5, further comprising a plurality of holding disks, each of said plurality of holding disks being positioned atop said base of a respective one of said plurality of cavities.

7. The template as recited in the claim 6, wherein each of said plurality of holding disks is moistened prior to receiving a wafer in its respective cavity.

8. The template as recited in the claim 5, wherein each pattern etched on said base of a respective one of said plurality of cavities is a unique pattern.

9. The template as recited in the claim 5, further comprising a plurality of shims, said plurality of shims selectively received within respective ones of said plurality of cavities for adjusting a depth of said respective cavities.

10. The template as recited in claim 1, wherein said pattern etched in said base of each of said plurality of cavities is formed from a combination of shapes, said shapes include at least a line, a circle, an arc, and a bean shaped opening.

11. A method for lapping and polishing a wafer, said method comprising the steps of:

a) forming a cavity within a main plate;

b) etching notches in a wall of the cavity;

c) etching a pattern on a base of the cavity;

d) moistening a holding disk;

e) positioning the moistened holding disk within the cavity;

f) positioning a wafer to be lapped and polished within the cavity above the holding disk whereby moisture within the holding disk creates a suctional force to retain the wafer within the cavity;

g) dispensing a moistening liquid onto the template thereby causing the liquid to diffuse into the notches in the wall of the cavity and be received by the pattern within the cavity further enhancing the suctional force used to retain the holding disk and wafer within the cavity;

h) releasably securing the template to a rotating head whereby a top surface of the main plate is facing a lapping and polishing surface and the wafer is in contact with the lapping and polishing surface;

i) rotating the rotating head and template to create a frictional force between the wafer and the lapping and polishing surface causing the wafer to be lapped and polished; and j) continuing rotation of the rotating head and the template until the thickness of the wafer is decreased a desired amount substantially equal to the amount of the wafer extending outside the cavity.

12. The method as recited in claim 11, further comprising the steps of:

a) forming a plurality of cavities within the main plate;

b) etching notches in the walls of each of the plurality of cavities;

c) etching a pattern on the base of each of the plurality of cavities;

d) moistening a plurality of holding disks;

e) positioning each respective one of the plurality of holding disks within a respective one of the plurality of cavities; and f) positioning a wafer to be lapped and polished within a respective one of each of the plurality of cavities above the respective holding disk whereby the moisture within the respective holding disk creates a suctional force to retain the wafer within the cavity.

13. The method as recited in claim 11, further comprising the step of placing at least one of the shims within a respective one of the respective plurality of cavities prior to said step of positioning a respective one of the holding disks within the cavity thereby adjusting the depth of the respective cavity.

14. The method as recited in claim 13, further comprising the step of placing a plurality of shims within a respective one of the respective plurality of cavities prior to said step of positioning a respective one of the holding disks within the cavity and thereby further adjusting the depth of the respective cavity.

15. A method for forming a main plate for use in lapping and polishing wafers, said method comprising the steps of:

a) cutting at least one cavity into a surface of the main plate, the cavity comprising a base and a wall extending from the base;

b) etching at least one notch in the wall of the at least one cavity; and c) etching a pattern in the base of the at least one cavity.

16. The method as recited in claim 15 further comprising the step of etching a plurality of notches in the walls of the at least one cavity.

17. The method as recited in claim 15, further comprising the step of cutting a plurality of cavities into the surface of the main plate, each respective one of the plurality of cavities having a base and a wall extending from the base.

18. The method as recited in claim 17 further comprising the step of etching a plurality of notches in the wall of each of the plurality of cavities.

19. The method as recited in claim 17 further comprising the step of etching a pattern in the base of each of the plurality of cavities.

20. The method as recited in claim 19, wherein each pattern etched is unique.

* * * * *